US005798008A

United States Patent [19]

Nogami et al.

[11] Patent Number: 5,798,008

[45] Date of Patent: Aug. 25, 1998

[54] METHOD FOR PRODUCING COPPER ALLOY MATERIALS FOR MOLDS FOR CONTINUOUS STEEL CASTING, AND MOLDS MADE OF THE MATERIALS

[75] Inventors: Keishi Nogami; Masato Koide; Takashi Morimoto, all of Sakai; Yutaka Koshiba, Tokyo, all of Japan

[73] Assignee: Mitsubishi Materials Corporation, Tokyo, Japan

[21] Appl. No.: 680,402

[22] Filed: Jul. 15, 1996

[30] Foreign Application Priority Data

Sep. 22, 1995 [JP] Japan ..... 7-244985

[51] Int. Cl.[6] ..... B22C 9/00; B22C 7/06

[52] U.S. Cl. ..... 148/682; 148/683; 148/684; 148/685

[58] Field of Search ..... 148/682, 685, 148/683, 684

[56] References Cited

U.S. PATENT DOCUMENTS 4,049,142 9/1977 Watson et al. ..... 75/153

FOREIGN PATENT DOCUMENTS 62-174341 7/1987 Japan .

*Primary Examiner*—Sikyin Ip

*Attorney, Agent, or Firm*—Oblon, Spivak, McClelland, Maier & Neustadt, P.C.

[57] ABSTRACT

A method for producing copper alloy materials for molds for continuous steel casting and molds as produced by the method. The molds are highly resistant to thermal fatigue and are hardly cracked. To produce the materials, cast ingots of a copper-based chromium-zirconium alloy comprising from 0.2 to 1.5% by weight of Cr and from 0.02 to 0.2% by weight of Zr are heated at between 900° C. and 1000° C. for 30 minutes or longer and then rolled, while hot, at a reduction ratio of 60% or more to be at 850° C. or higher at which the hot rolling is finished , and immediately after the hot rolling, these are rapidly cooled to 400° C. or lower at a cooling rate of 10°C./sec or more, and then aged at between 400° C. and 520° C. for from 1 hour to 5 hours.

8 Claims, 3 Drawing Sheets

METHOD FOR PRODUCING COPPER ALLOY MATERIALS FOR MOLDS FOR CONTINUOUS STEEL CASTING, AND MOLDS MADE OF THE MATERIALS

BACKGROUND OF THE INVENTION

1. Field of the Invention

The present invention relates to a method for producing copper alloy materials for molds for continuous casting of steel, and to molds made of the materials.

2. Discussion of the Background

As having excellent thermal conductivity and high-temperature strength, copper-based chromium-zirconium alloys are used as materials for molds for continuous steel casting. It has been known that molds made of copper-based chromium-zirconium alloys are excellent in the property of removing the heat of steel melt to cool and solidify the melt therein and exhibit excellent resistance to thermal stress deformation when exposed to high temperatures.

However, if used longer than a determined period of time, conventional molds made of copper-based alloys of this type are often cracked due to their thermal fatigue caused by a lengthwise variation in the meniscus of the steel melt therein that occurs during continuous steel casting in the mold. As being often cracked in this manner, the conventional molds were problematic in that their life is limited. Therefore, copper-based chromium-zirconium alloy molds which could be more resistant to thermal fatigue have heretofore been desired.

The present invention has been made in consideration of the current situations as mentioned above, and an object of the present invention is to provide for a method for producing copper alloy materials for molds for continuous steel casting, which are resistant to thermal fatigue and hardly crack, and also to provide for molds made of the materials.

The present inventors have studied the concept of obtaining copper-based chromium-zirconium alloy molds having higher resistance to thermal fatigue than the conventional ones and, as a result, have discovered the following. That is, the present inventors found that, in conventional methods of producing molds, the balance between the intergranular strength and the intragranular strength of the alloy used is bad, and the intragranular phase is too much reinforced as compared with the intergranular phase with the result that thermal stress is easily concentrated in the intergranular phase thereby frequently causing intergranular breakage of the alloy. In addition, the inventors have further found that the reason for the intergranular breakage is essentially because of the step of preparing solid solutions of alloy melts in the conventional methods, which promotes the intragranular precipitation in the melt and therefore reinforces only the intragranular phase of the melt. Accordingly, the present inventors have considered that, if the intragranular strength and the intergranular strength of the copper alloys could be well balanced, it will be possible to obtain copper alloy mold materials which are satisfactorily resistant to thermal fatigue. On the basis of these findings and consideration, the present inventors have further studied to establish the conditions under which copper alloys having well-balanced strength can be obtained in the absence of the step of preparing solid solutions of alloy melts. As a result of the studies, the present inventors have now completed the present invention herein.

SUMMARY OF THE INVENTION

The present invention has been attained as a result of the above-mentioned studies and is characterized by the following aspects:

(1) First, the present invention provides a method for producing copper alloy material for molds for continuous steel casting, which is characterized in that cast ingots of a copper-based chromium-zirconium alloy comprising from 0.2 to 1.5% by weight of Cr and from 0.02 to 0.2% by weight of Zr are heated at between 900° C. and 1,000° C. for 30 minutes or longer and then worked, while hot, at a reduction ratio of 60% or more to be at 850° C. or higher at which the hot working is finished, and immediately after the hot working, these are rapidly cooled to 400° C. or lower at a cooling rate of 10° C./sec or more, and then aged at between 400° C. and 520° C. for from 1 hour to 5 hours to give mold materials.

(2) Secondly, the method of the present invention for producing copper alloy materials for molds for continuous steel casting as in (1) is characterized in that the hot working is hot rolling.

(3) Thirdly, the present invention provides a method for producing copper alloy molds for continuous steel casting, which is characterized in that the copper alloy materials for molds for continuous steel casting as in (1) or (2) are worked, for example, through machining to give molds.

The copper alloy molds for continuous steel casting which are produced according to the method as in (3) are characterized in that the grains constituting them have a grain size of 0.075 mm or less. The grain size as referred to herein is measured according to the Cut Method of JIS-H0501-1986.

The present invention therefore provides for a method for producing copper alloy materials for molds for continuous steel casting, the method comprising the steps of heating cast ingots of a copper-based chromium-zirconium alloy comprising from 0.2 to 1.5% by weight of Cr and from 0.02 to 0.2% by weight of Zr at between 900° C. and 1000° C. for 30 minutes or longer; working the cast ingots, while hot, at a reduction ratio of 60% or more to be at 850° C. or higher at which the hot working is finished; rapidly cooling the cast ingots immediately after the hot working to 400° C. or lower at a cooling rate of 10° C./sec or more; and aging the cast ingots at between 400° C. and 520° C. for from 1 hour to 5 hours to provide for mold materials.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
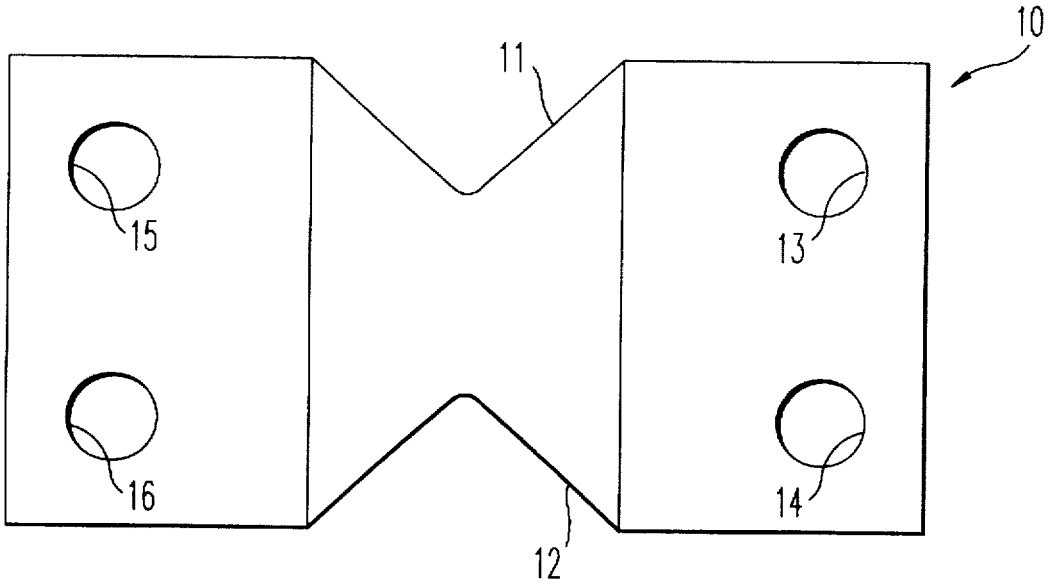
FIG. 1 is a plan view of a test piece used in the thermal fatigue test as carried out herein.

In the present invention, the working conditions have been limited for the following reasons:

(a) Alloy composition:

The alloy composition to be employed in the present invention is an ordinary one for copper alloy molds for continuous steel casting. However, the alloy composition for use in the present invention may comprise Mg, Si, Al, Ni, Sn, Fe, Mn, Ag, Co, B and/or P in an amount not more that 0.2% of each. Even comprising such components, the alloys can be used to attain the effects of the present invention. More preferably, the alloy composition comprises from 0.6 to 1.2% by weight of Cr and from 0.05 to 0.18% by weight of Zr.

(b) Temperature at which cast ingots are heated prior to being hot-worked:

If cast ingots are heated at a temperature higher than 1,000° C. prior to being hot-worked, their hot-workability (hot-rollability) is worsened. If they are heated at a temperature lower than 900° C., the strength of the final products to be obtained is lowered. More preferably, the heating temperature falls between 920° C. and 980° C.

(c) Reduction ratio:

After having been heated, the cast ingots shall be worked, while hot, at a reduction ratio of 60% or more whereby their metallic structure is broken to make the crystals constituting them sufficiently fine and thus they can have the necessary mechanical strength. More preferably, the reduction reaction falls between 70% and 85%. The reduction ratio is obtained according to the following numerical formula:

$$\textit{Reduction ratio } (r)=(h_0-h_1)h_0\times 100\ [\%]$$

wherein $h_0$ is the thickness of the un-rolled ingot and $h_1$ is the thickness of the rolled ingot.

(d) Temperature of hot-worked ingots:

If the temperature at which the hot-working of the cast ingots is finished is lower than 850° C., the hot-worked ingots could not have sufficient mechanical strength with which they are usable as mold materials. More preferably, the temperature falls between 900° C. and 950° C.

(e) Cooling speed at which hot-worked ingots are cooled:

The hot-worked ingots shall be cooled at a cooling rate of 10° C./sec or larger. If the range is smaller than 10° C./sec, the ingots could hardly have the necessary mechanical strength. More preferably, the rate falls between 12° C./sec and 18° C./sec.

(f) Aging temperature:

The temperature at which the ingots are aged shall fall between 400° C. and 520° C. This condition is the same as that employed in conventional methods for producing ordinary copper alloy materials for molds for continuous steel casting. More preferably, the temperature falls between 440° C. and 490° C.

(g) Grain size:

The grains constituting the copper alloy mold of the present invention shall have a grain size of 0.075 mm or smaller. If not, that is, if the grain size is larger than 0.075 mm, the copper alloy mold could hardly have sufficient fatigue resistance. In addition, the intergranular area of the alloy increases with the increase in the grain size to thereby worsen the balance between the intragranular strength and the intergranular strength of the alloy with the result that the thermal fatigue resistance of the mold is significantly lowered.

One example of the present invention is mentioned below along with a comparative example.

EXAMPLE 1

A copper alloy comprising 0.75% of Cr, 0.07% of Zr and, as the balance, copper and inevitable impurities was continuously cast into an ingot having a thickness in the cross-sectional direction of 260 mm and a width of 640 mm. The cast ingot was cut into two samples having a length of 1000 mm that shall be subjected to a rolling test. One of these was used in Example 1 that demonstrates the method of the present invention, while the other in Comparative Example to follow hereinafter (this demonstrates a conventional method). The former was heated at 980° C. for 60 minutes and then hot-rolled into a slab having a thickness of 80 mm, a width of 640 mm and a length of about 3300 mm. The temperature of the slab at which the hot-rolling thereof was finished was 900° C. Immediately after the hot-rolling, cool water was directly poured over the slab whereby the slab was cooled to 380° C. over a period of 40 seconds. The cooling speed was 14° C./sec. After this, the slab was cooled to room temperature and then aged at 475° C. for 3 hours. The slab thus obtained herein is Example 1 of a copper alloy material for molds for continuous steel casting of the present invention.

Test pieces were prepared from the slab of Example 1, which were subjected to an ordinary , repeated bending fatigue test (this may be referred to as a four-point bending rotary fatigue test or as an Ono-type rotary fatigue test). The stress as imparted to the test pieces in this test was 15 kg/mm$^2$. The results are shown in Table 1 below.

TABLE 1

| | Example 1 | Comparative Example |
|---|---|---|
| Stress | 15 kg/mm$^2$ | 15 kg/mm$^2$ |
| Cycle (N) | Not broken after $10^7$ cycles | Broken after 5.15 × $10^5$ cycles |

Other test pieces were prepared from slab of Example 1, which were subjected to a thermal fatigue test. The details of the test are mentioned below with reference to the drawings attached hereto.

Figure 2:
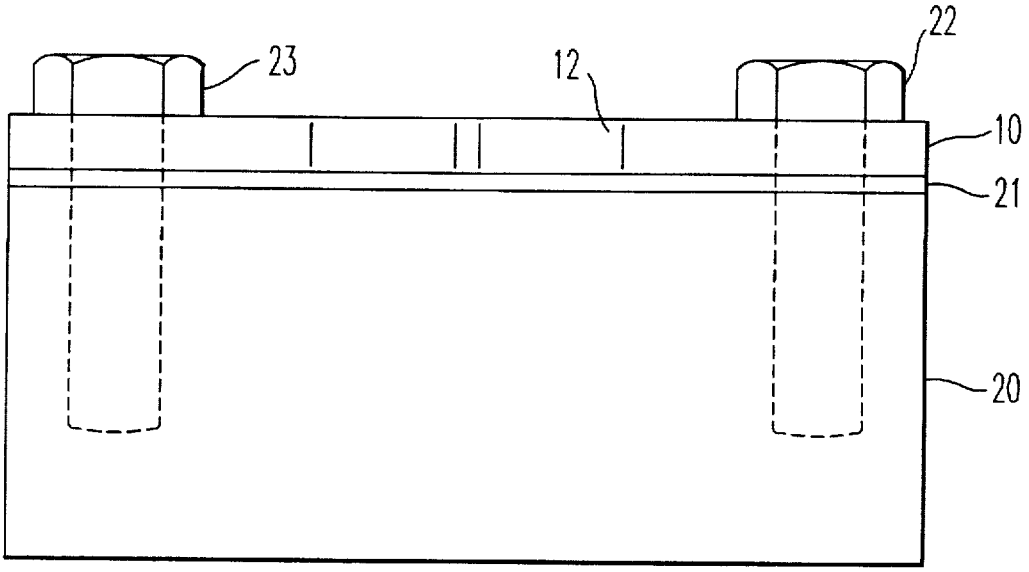
FIG. 2 is a front view illustrating the thermal fatigue test as carried out herein, in which a test piece has been mounted on a sample stand.

Referring to the drawings, wherein like reference numerals designate identical or corresponding parts throughout the several views, FIG. 1 shows a test piece 10 to be used in the thermal fatigue test. The test piece 10 is tabular and has a thickness of 5 mm. Both sides of the test piece 10 were cut to form nearly triangular cut-out parts 11 and 12. The apexes (tips) of the cut-out parts 11 and 12 were rounded at R3. Four through-holes 13 to 16 were formed at the edges of the test piece 10. As shown in FIG. 2, the test piece 10 was mounted on a stainless support block 20, which is a rectangular parallelopipedon, by means of bolts 22 and 23. The bolts 22 and 23 were screwed into the support block 20 through the through-holes 13 to 16. The material of the support block 20 was so selected that its thermal expansion coefficient is almost the same as that of the test piece 10. Between the test piece 10 and the support block 20, interposed was a heat-insulating sheet 21.

Figure 3:
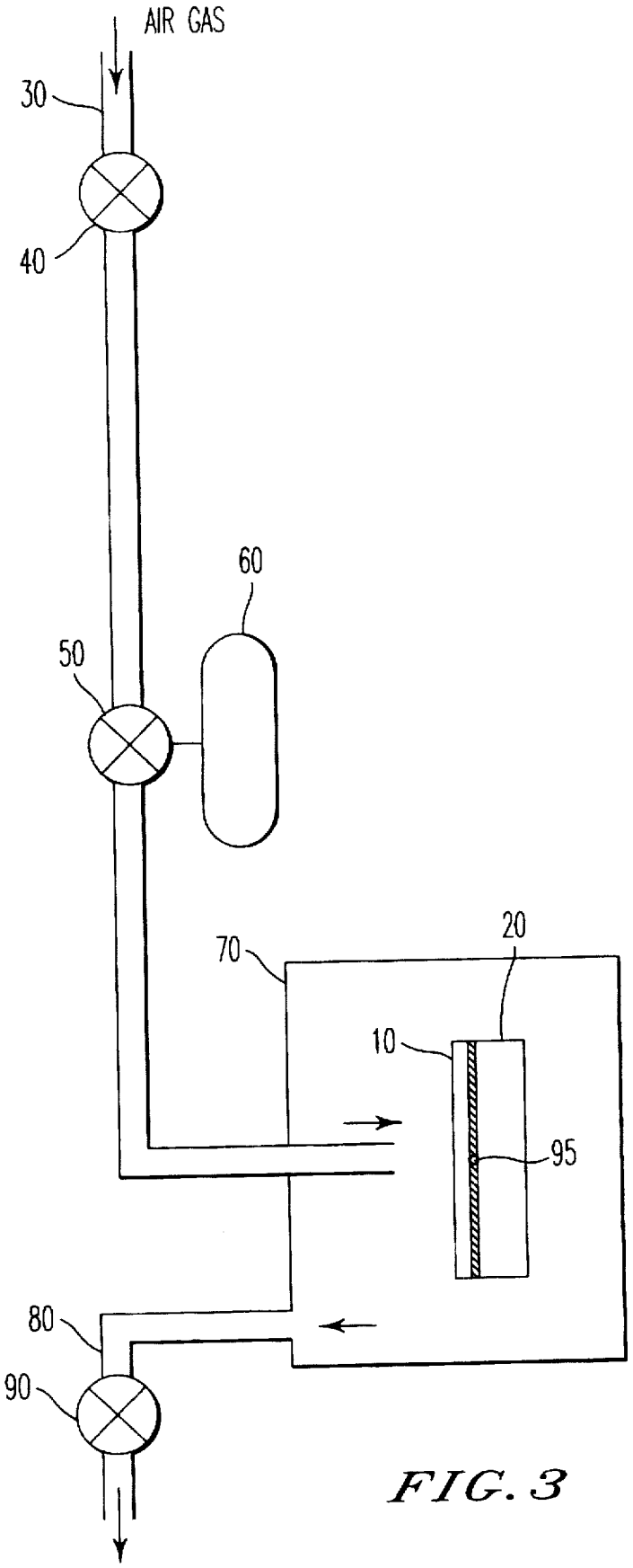
FIG. 3 is a schematic view illustrating the thermal fatigue test as carried out herein.

The outline of the apparatus for the thermal fatigue test is mentioned below with reference to FIG. 3. The apparatus essentially comprises an Ar gas-introducing duct 30 connected with an Ar gas source, a flow meter 40 installed in the duct 30, a solenoid valve 50, a timer 60 via which the solenoid valve 50 is opened and shut at predetermined cycles, an electric furnace 70 installed downstream of the duct 30, an exhaust duct 80 through which the exhaust gas from the electric furnace 70 is led to gas-treating equipment, and a check valve 90 installed in the middle of the duct 80.

The electric furnace 70 is equipped with a temperature-controlling means with which the inner temperature of the electric furnace 70 is controlled at a predetermined temperature. In the inside of the electric furnace 70, the test piece 10 mounted on the support block 20 is set horizontally by means of a suitable support means. The downstream end of the duct 30 is positioned above the outer surface of the test piece 10 in such a manner that Ar gas can be jetted out therethrough around the cut-out parts 11 and 12. To the test piece 10 as set inside the electric furnace 70, fitted was a thermo-couple 95 with which the temperature of the test piece 10 can be measured.

Figure 4:
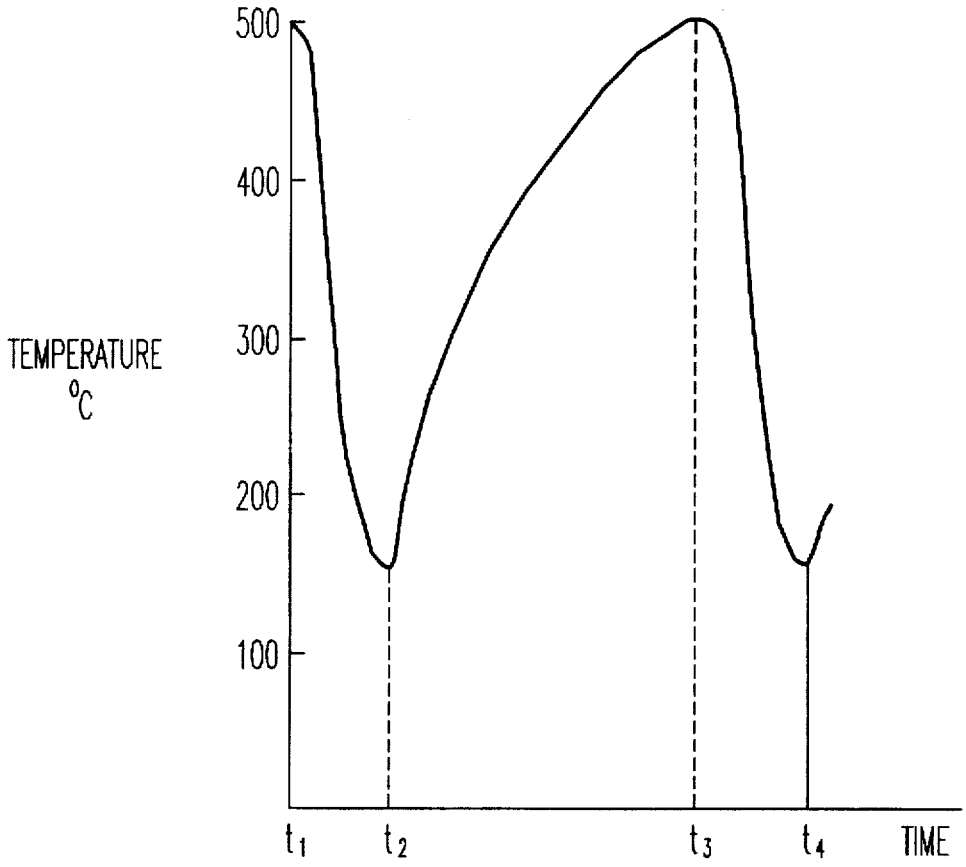
FIG. 4 is a graph showing the temperature condition in the thermal fatigue test as carried out herein.

The thermal fatigue test to be carried out using the apparatus is mentioned below with reference to FIG. 3 to FIG. 5. First, while the solenoid valve 50 is shut, the inside of the electric furnace is heated up to 500° C. The heating causes the thermal expansion of the test piece 10 and the support block 20 as set inside the electric furnace 70. Since the material of the support block 20 was so selected that its thermal expansion coefficient is the same as that of the test piece 10, the stress to the test piece 10 is not almost changed during the process of the present thermal expansion.

Figure 5:
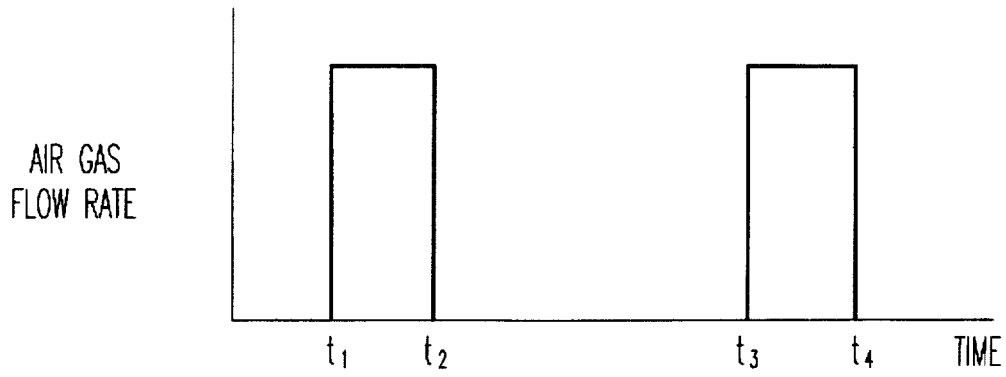
FIG. 5 is a graph showing the gas flow condition in the thermal fatigue test as carried out herein.

Next, the solenoid valve 50 is kept opened in accordance with the information from the timer 60 for a period between the time $t_1$ and the time $t_2$ (for 10 seconds), via which Ar gas flows through the duct 30 (see FIG. 5). Accordingly, Ar gas is introduced into the electric furnace 70 and jetted over the test piece 10, with which the test piece 10 is rapidly cooled (see FIG. 4). In FIG. 4, the vertical axis shows the temperature as indicated by the thermo-couple 95 connected with the test piece 10 (that is, the vertical axis indicates the temperature of the test piece 10). By the rapid cooling, the test piece 10 shall be contracted. On the other hand, since the support block 20 has a sufficiently large heat capacity and is so arranged that Ar gas is not directly sprayed over it, it is cooled much more slowly than the test piece 10. Therefore, the test piece 10 as fixed onto the support block via the bolts 22 and 23 could not shrink so that it undergoes thermal stress in the tensile direction (that is, in the right and left direction in FIG. 1). The thermal stress is concentrated at the apexes of the cut-out parts 11 and 12.

Next, the solenoid valve 50 is kept shut in accordance with the information from the timer 60 for a period between the time $t_2$ and the time $t_3$ (for 220 seconds). During this period, the electric furnace 70 is heated. In this example, the inner temperature of the electric furnace 70 shall not be higher than 500° C. Accordingly, the inside of the electric furnace is heated up to 500° C., as shown in FIG. 4.

Next, the solenoid valve 50 is again kept opened in accordance with the information from the timer 60 for a period between the time $t_3$ and the time $t_4$. In this condition, the same process as above between the time $t_1$ and the time $t_2$ is repeated. The operations after this are the same as above and are omitted herein.

Next, the above-mentioned cycle between the time $t_2$ and the time $t_4$ is repeated 2000 times (for about 5.3 days). After this, the test piece 10 is taken out of the electric furnace 70 and its surface is observed.

The test piece 10 of Example 1 was tested in the manner as above. After the test, it was neither broken nor cracked.

The mechanical characteristics of the mold material (slab) of Example 1 are shown in Table 2 below.

TABLE 2

| | Tensile Strength (kgf/mm²) | Mechanical Strength (kgf/mm²) | Elongation (%) | Electro-conductivity (% IACS) | Grain Size (mm) |
|---|---|---|---|---|---|
| Example 1 | 42.3 | 32.4 | 35 | 87.8 | 0.045 (uniform) |
| Comparative Example | 39.5 | 28.3 | 29 | 85.4 | 0.080–0.200 (not uniform) |

Comparative Example

As a comparative example, another sample of the cast ingot prepared above was processed and worked according to an ordinary method to prepare a mold material (slab) for molds for continuous steel casting. Therefore, the composition, the shape and the dimension of the cast ingot sample used in this comparative example are the same as those of the sample used in Example 1. In the comparative example, the cast ingot sample was heated at 850° C. for 60 minutes and then rolled, while hot, into a slab having a thickness of 80 mm, a width of 640 mm and a length of about 3300 mm. The temperature of the slab, at which the hot-rolling thereof was finished was 810° C. After the hot-rolling, the resulting slab was left cooled and then heated at 980° C. for 1 hour to make it stand in solid solution. Next, this was rapidly cooled in water and then aged at 475° C. for 3 hours. Thus was obtained herein a comparative slab sample of a copper alloy material for molds for continuous steel casting.

Test pieces were prepared from the slab of the comparative example, which were subjected to the repeated bending fatigue test under the same conditions as in Example 1. The results obtained have been shown in Table 1 above.

The slab of the comparative example was also subjected to the thermal fatigue test under the same conditions as in Example 1. After the test, the test pieces of the comparative example were visibly cracked at the apexes of the cut-out parts 11 and 12. The mechanical characteristics of the mold material (slab) of the comparative example have been shown in Table 2 above.

As is obvious from the results shown in Tables 1 and 2, and the results of the thermal fatigue test, it is noted that the copper alloy mold material as produced in Example 1 is more resistant to thermal fatigue and is hardly cracked when compared to that produced in the comparative example.

As has been mentioned hereinabove, it is possible according to the present invention to produce copper alloy mold materials and copper alloy molds for continuous steel casting which are highly resistant to thermal fatigue and which are hardly cracked. Therefore, the present invention is effective in prolonging the life of copper alloy molds for continuous steel casting.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by letters patent of the United States is:

1. A method for producing copper alloy materials for molds for continuous steel casting, the method comprising the steps of:

heating cast ingots of a copper-based chromium-zirconium alloy consisting essentially of from 0.2 to 1.5% by weight of Cr and from 0.02 to 0.2% by weight of Zr with the balance being Cu and inevitable impurities at between 900° C. and 1000° C. for 30 minutes or longer;

hot working said cast ingots at a reduction ratio of 60% or more to be at 850° C. or higher at which the hot working is finished;

rapidly cooling i cast ingots immediately after the hot working to 400° C. or lower at a cooling rate of 10° C./sec or more; and aging said cast ingots at between 400° C. and 520° C. for from 1 hour to 5 hours to provide for mold materials.

2. A method for producing copper alloy materials for molds for continuous steel casting as claimed in claim 1, wherein said hot working is hot rolling.

3. A method for producing copper alloy molds for continuous steel casting, comprising working the copper alloy material as claimed in claim 1 into molds.

4. A copper alloy mold for continuous steel casting, which is produced according to the method as claimed in claim 3, wherein grains constituting said mold have a grain size of 0.075 mm or less.

5. A method for producing copper alloy materials for molds for continuous steel casting, the method comprising the steps of:

heating cast ingots of a copper-based chromium-zirconium alloy consisting essentially of Cr in an amount of 0.2 to 1.5% by weight, Zr in an amount of 0.02 to 0.2% by weight and at least one selected from the group consisting of Mg, Si, Al, Ni, Sn, Fe, Mn, Ag, Co, B and P in an amount up to 0.2% by weight with the balance being Cu and inevitable impurities at between 900° C. and 1000° C. for 30 minutes or longer;

hot working said cast ingots at a reduction ratio of 60% or more to be at 850° C. or higher at which the hot working is finished;

rapidly cooling said cast ingots immediately after the hot working to 400° C. or lower at a cooling rate of 10° C./sec or more; and aging said cast ingots at between 400° C. and 520° C. for from 1 hour to 5 hours to provide for mold materials.

6. A method for producing copper alloy materials for molds for continuous steel casting as claimed in claim 5, wherein said hot working is hot rolling.

7. A method for producing copper alloy materials for molds for continuous steel casting as claimed in claim 5, further comprising working said copper alloy material into molds.

8. A copper alloy mold for continuous steel casting, which is produced according to the method as claimed in claim 7, wherein grains constituting said mold have a grain size of 0.075 mm or less.

* * * * *